US006410837B2

(12) United States Patent
Tsutsumi

(10) Patent No.: US 6,410,837 B2
(45) Date of Patent: Jun. 25, 2002

(54) REMIX APPARATUS AND METHOD, SLICE APPARATUS AND METHOD, AND STORAGE MEDIUM

(75) Inventor: Satoru Tsutsumi, Hamamatus (JP)

(73) Assignee: Yamaha Corporation, Hamamatsu (JP)

( * ) Notice: Subject to any disclaimer, the term of this patent is extended or adjusted under 35 U.S.C. 154(b) by 0 days.

(21) Appl. No.: 09/804,739

(22) Filed: Mar. 13, 2001

(30) Foreign Application Priority Data

Mar. 15, 2000 (JP) ..... 2000-071684

(51) Int. Cl.[7] ..... G10H 7/00
(52) U.S. Cl. ..... 84/604
(58) Field of Search ..... 84/603–605

(56) References Cited

U.S. PATENT DOCUMENTS 4,785,702 A 11/1988 Katoh
5,824,933 A * 10/1998 Gabriel
5,915,288 A * 6/1999 Gabriel
5,952,598 A * 9/1999 Goede ..... 84/603 X
5,973,255 A * 10/1999 Tanji ..... 84/604 X
6,281,421 B1 * 8/2001 Kawaguchi

FOREIGN PATENT DOCUMENTS

JP 10-136137 4/1998

* cited by examiner

*Primary Examiner*—Jeffrey Donels
(74) *Attorney, Agent, or Firm*—Morrison & Foerster LLP

(57) ABSTRACT

A remix apparatus and method and slice apparatus and method is provided, which are capable of generating new musical tone pattern data from previously generated musical tone pattern data in real time, and storage media storing programs for implementing these methods. Musical tone pattern data of a predetermined length stored in a flash memory or a RAM is divided into a plurality of musical tone piece data of a length smaller than the predetermined length, and location information indicative of locations in the flash memory where the musical tone piece data obtained by the division are stored is stored in the flash memory. When a user selects one of plural types of stored rearrangement information, the location information on the musical tone piece data is supplied such that the musical tone piece data are rearranged in an order indicated by the selected rearrangement information and the musical tone piece data are sequentially reproduced in an order indicated by the supplied location information, that is, the musical tone piece data are rearranged based on the location information which requires a small amount of data to be controlled. Therefore, new musical tone pattern data can be generated from previously generated musical tone pattern data in real time.

25 Claims, 8 Drawing Sheets

WAVEFORM SIGNALS FROM OUTSIDE
IT
15
WAVEFORM I/O
16
9
PANEL DISPLAY
2
PANEL OPERATING ELEMENT
4
OPERATING ELEMENT DETECTING CIRCUIT
1
KEYBOARD
3
KEY DEPRESSION DETECTING CIRCUIT
17
BUS
COMMUNI-CATION I/F
14
MIDI I/F
13
CD-ROM
12
HDD
11
FDD
10
TIMER
8
CPU
5
RAM
7
FLASH MEMORY
6
21
20
COMMUNICATION NETWORK
101
102
100
SERVER COMPUTER
OTHER MIDI EQUIPMENT

ORIGINAL WAVEFORM
1
2
3
4
5
6
7
8
VARI
1
2
3
4
5
6
7
8
9
10
R
S
R
S
R
S
R
R
R

REMIX APPARATUS AND METHOD, SLICE APPARATUS AND METHOD, AND STORAGE MEDIUM

BACKGROUND OF THE INVENTION

1. Field of the Invention

The present invention relates to a remix apparatus and method that generate new musical tone pattern data by dividing previously generated musical tone pattern data into a plurality of musical tone data (each musical tone data will be hereinafter referred to as "musical tone piece data") and combining together the musical tone piece data obtained by the division, and a storage medium storing a program for implementing the method, and also relates to a slice apparatus and method that generates further new musical tone pattern data by cutting off a part of each of the plural musical tone piece data obtained by the division, and a storage medium storing a program for implementing the method.

2. Prior Art

A remix apparatus for generating new musical tone pattern data from previously generated musical tone pattern data is already known, for example, from Japanese Laid-Open Patent Publication (Kokai) No. 11-344976.

This remix apparatus divides previously generated and stored musical tone pattern data into a plurality of musical tone piece data and then rearranges the individual musical tone piece data obtained by the division, based on random numbers, thereby generating new musical tone pattern data.

This conventional remix apparatus, however, does not generate new musical tone pattern data in real time, that is, executes generation of new musical tone pattern data independently of reproduction thereof. Thus, further new musical tone pattern data cannot be generated during reproduction of the generated new musical tone pattern data.

Similarly to this conventional remix apparatus, conventional slice apparatuses do not generate new musical tone pattern data in real time. Thus, further new musical tone pattern data cannot be generated during reproduction of the generated new musical tone pattern data.

SUMMARY OF THE INVENTION

It is an object of the present invention to provide a remix apparatus and method and slice apparatus and method which are capable of generating new musical tone pattern data from previously generated musical tone pattern data in real time, and storage media storing programs for implementing these methods.

To attain the above object, in a first aspect of the present invention, there is provided a remix apparatus comprising a first storage device that stores musical tone pattern data of a predetermined length, a dividing device that divides the stored musical tone pattern data of the predetermined length into a plurality of musical tone piece data of a length smaller than the predetermined length, a second storage device that stores location information indicative of locations in the first storage device where the musical tone piece data obtained by the division are stored, a third storage device that stores a plurality of types of rearrangement information for use in rearranging the musical tone piece data obtained by the division, an operating element device that allows a user to select one of the stored plurality of types of rearrangement information, a supplying device that supplies the location information on the musical tone piece data such that the musical tone piece data are rearranged in an order indicated by the rearrangement information selected by the user using the operating element device, and a reproducing device that sequentially reproduces the musical tone piece data in an order indicated by the supplied location information.

Preferably, the remix apparatus according to the first aspect further comprises a control information generating device that generates control information for controlling a reproduction manner of reproducing the musical tone piece data by the reproducing device, and a control device that controls the reproduction manner according to the generated control information.

For example, the control information provides such control that at least one of the musical tone piece data in a position of a predetermined ordinal number is reproduced in a reverse direction.

The control information may provide such control that at least one of the musical tone piece data in a position of a predetermined ordinal number is not reproduced.

The control information may provide such control that at least one of the musical tone piece data in a position of a predetermined ordinal number is reproduced while being subjected to a predetermined effect process.

The control information may provide such control that at least one of the musical tone piece data in a position of a predetermined ordinal number is reproduced while being subjected to a low fidelity process.

The control information may provide such control that at least one of the musical tone piece data in a position of a predetermined ordinal number is reproduced with at least one of volume and pitch thereof varied.

The first aspect of the present invention further provides a remix method comprising a first storing step of storing musical tone pattern data of a predetermined length in a first storage device, a dividing step of dividing the stored musical tone pattern data of the predetermined length into a plurality of musical tone piece data of a length smaller than the predetermined length, a second storing step of storing location information indicative of locations in the first storage device where the musical tone piece data obtained by the division are stored, in a second storage device, a third storing step of storing a plurality of types of rearrangement information for use in rearranging the musical tone piece data obtained by the division. in a third storage device, a supplying step of supplying the location information on the musical tone piece data such that the musical tone piece data are rearranged in an order indicated by the rearrangement information selected by the user using an operating element device that allows a user to select one of the stored plurality of types of rearrangement information, and a reproducing step of sequentially reproducing the musical tone piece data in an order indicated by the supplied location information, as well as a machine-readable storage medium containing a group of instructions for causing a machine to execute the remix method.

According to the first aspect of the present invention, musical tone pattern data of a predetermined length stored in a first storage device is divided into a plurality of musical tone piece data of a length smaller than the predetermined length, and location information indicative of locations in the first storage device where the musical tone piece data obtained by the division are stored is stored in a second storage device. When a user selects one of plural types of stored rearrangement information, the location information on the musical tone piece data is supplied such that the musical tone piece data are rearranged in an order indicated by the selected rearrangement information and the musical tone piece data are sequentially reproduced in an order indicated by the supplied location information, that is, the musical tone piece data are rearranged based on the location information which requires a small amount of data to be controlled. Therefore, new musical tone pattern data can be generated from previously generated musical tone pattern data in real time.

To attain the above object, in a second aspect of the present invention, there are provided a remix apparatus comprising a storage device that stores predetermined pattern data of a predetermined length, a reproducing device that reproduces the stored musical tone pattern data in a manner such that when reproduction of the stored musical tone pattern data proceeds to a trailing position of the musical tone pattern data, it is returned to a leading position of the musical tone pattern data to continue reproduction, an operating element device that is operated by a user, an accepting device that accepts operating element information generated by a user by operating the operating element device at an intermediate position between the leading position and the trailing position of the musical tone pattern data when the reproduction of the musical tone pattern data stored in the storage device is being carried out at the intermediate position between the leading position and the trailing position of the musical tone pattern data, a control information generating device that generates control information for controlling a manner of the reproduction based on the accepted operating element information, in timing when the reproduction starts to return to the leading position of the musical tone pattern data upon proceeding to the trailing position thereof, and a control device that controls the manner of the reproduction based on the generated control information, and a remix apparatus comprising a storage device that stores predetermined pattern data of a predetermined length, a reproducing device that reproduces the stored musical tone pattern data in a manner such that when reproduction of the stored musical tone pattern data proceeds to a trailing position of the musical tone pattern data, it is returned to a leading position of the musical tone pattern data to continue reproduction, an operating element device that is operated by a user, an accepting device that accepts operating element information generated by a user by operating the operating element device at an intermediate position between the leading position and the trailing position of the musical tone pattern data when the reproduction of the musical tone pattern data stored in the storage device is being carried out at the intermediate position between the leading position and the trailing position of the musical tone pattern data, a control information generating device that generates control information for controlling a manner of the reproduction based on the accepted operating element information, in timing when the reproduction starts to return to the leading position of the musical tone pattern data upon proceeding to the trailing position thereof, and a control device that controls the manner of the reproduction based on the generated control information, as well as a machine-readable storage medium containing a group of instructions for causing a machine to execute the remix method.

According to the second aspect of the present invention, when reproduction of musical tone pattern data stored in a storage device is being carried out at an intermediate position between a leading position and a trailing position of the musical tone pattern data, operating element information generated by a user by operating an operating element device at the intermediate position is accepted, and in timing when the reproduction starts to return to the leading position of the musical tone pattern data upon proceeding to the trailing position thereof, control information for controlling a manner of the reproduction is generated based on the accepted operating element information. Thus, the manner of the reproduction can be controlled based on the generated control information. Therefore, the manner of the current reproduction can be easily compared with the manner of the next reproduction to allow the user to more easily operate the apparatus.

To attain the above object, in a third aspect of the present invention, there are provided a remix apparatus comprising a first storage device that stores musical tone pattern data of a predetermined length, a dividing device that divides the stored musical tone pattern data of the predetermined length into a plurality of musical tone piece data of a length smaller than the predetermined length, a second storage device that stores location information indicative of locations in the first storage device where the musical tone piece data obtained by the division are stored, a third storage device that stores a plurality of types of rearrangement information for use in rearranging the musical tone piece data obtained by the division, an operating element device that allows a user to select one of the plurality of types of stored rearrangement information, a supplying device that supplies the location information on the musical tone piece data such that the musical tone piece data are rearranged in an order indicated by the rearrangement information selected by the user using the operating element device, a reproducing device that sequentially reproduces the musical tone piece data in an order indicated by the supplied location information in a manner such that when the reproduction proceeds to a trailing position of the musical tone pattern data, it is returned to a leading position of the musical tone pattern data to continue reproduction, and an accepting device that accepts the rearrangement information selected by a user by operating the operating element device at an intermediate position between the leading position and the trailing position of the musical tone pattern data when the reproduction of the musical tone piece data stored in the storage device is being carried out at the intermediate position between the leading position and the trailing position of the musical tone pattern data, wherein the supplying device supplies the location information on the musical tone piece data such that the musical tone piece data are arranged in the order indicated by the accepted rearrangement information, in timing when the reproduction starts to return to the leading position of the musical tone pattern data upon proceeding to the trailing position thereof, a remix method comprising a first storing step of storing musical tone pattern data of a predetermined length in a first storage device, a dividing step of dividing the stored musical tone pattern data of the predetermined length into a plurality of musical tone piece data of a length smaller than the predetermined length, a second storing step of storing location information indicative of locations in the first storage device where the musical tone piece data obtained by the division are stored, in a second storage device, a third storing step of storing a plurality of types of rearrangement information for use in rearranging the musical tone piece data obtained by the division, in a third storage device, a supplying step of supplying the location information on the musical tone piece data such that the musical tone piece data are rearranged in an order indicated by the rearrangement information selected by the user using an operating element device that allows a user to select one of the plurality of types of stored rearrangement information, a reproducing step of sequentially reproducing the musical tone piece data in an order indicated by the supplied location information in a manner such that when reproduction of the musical tone piece data proceeds to a trailing position of the musical tone pattern data, it is returned to a leading position of the musical tone pattern data to continue reproduction, and an accepting step of accepting the rearrangement information selected by a user by operating the operating element device at an intermediate position between the leading position and the trailing position of the musical tone pattern data when the reproduction of the musical tone pattern data stored in the storage device is being carried out at the intermediate position between the leading position and the trailing position of the musical tone pattern data, wherein the supplying device supplies the location information on the musical tone piece data such that the musical tone piece data are arranged in the order indicated by the accepted rearrangement information, in timing when the reproduction starts to return to the leading position of the musical tone pattern data upon proceeding to the trailing position thereof, as well as a machine-readable storage medium containing a group of instructions for causing a machine to execute the remix method.

According to the third aspect of the present invention, musical tone pattern data of a predetermined length stored in a first storage device is divided into a plurality of musical tone piece data of a length smaller than the predetermined length, and location information indicative of locations in the first storage device where the musical tone piece data obtained by the division are stored is stored in a second storage device. When a user selects one of plural types of stored rearrangement information, the location information on the musical tone piece data is supplied such that the musical tone piece data are rearranged in an order indicated by the selected rearrangement information. When reproduction of the musical tone pattern data performed in an order indicated by the supplied location information is carried out at an intermediate position between a leading position and a trailing position of the musical tone pattern data, the rearrangement information selected by the user by operating an operating element device at the intermediate position is accepted, and in timing when the reproduction starts to return to the leading position of the musical tone pattern data upon proceeding to the trailing position thereof, the location information on the musical tone piece data is supplied such that the musical tone piece data are rearranged in an order indicated by the accepted rearrangement information. That is, the musical tone piece data are rearranged based on the location information which requires a small amount of data to be controlled, and the current rearrangement can be easily compared with the next rearrangement, based on the location information which requires a small amount of data to be controlled. Therefore, new musical tone piece data can be generated from previously generated musical tone pattern data in real time, and the user can more easily operate the apparatus.

To attain the above object, in a fourth aspect of the present invention, there are provided a slice apparatus comprising a first storage device that stores musical tone pattern data of a predetermined length, a second storage device that stores a plurality of types of division information for dividing the stored musical tone pattern data of the predetermined length into a plurality of musical tone piece data of a length smaller than the predetermined length, a first operating element that selects one of the stored plurality of types of division information, a dividing device that divides the stored musical tone pattern data of the predetermined length into the plurality of musical tone piece data based on the division information selected by the first operating element, a second operating element that is used to input rate information indicative of a rate of each of the musical tone piece data obtained by the division, to be reproduced, and a reproducing device that reproduces each of the musical tone piece data by a length corresponding to the rate information input by the second operating element, and a slice method comprising a first storing step of storing musical tone pattern data of a predetermined length in a first storage device, a second storing step of storing a plurality of types of division information for dividing the stored musical tone pattern data of the predetermined length into a plurality of musical tone piece data of a length smaller than the predetermined length, in a second storage device, a dividing step of dividing the stored musical tone pattern data of the predetermined length into the plurality of musical tone piece data based on the division information selected by a first operating element that selects one of the stored plurality of types of division information, and a reproducing step of reproducing each of the musical tone piece data by a length corresponding to rate information indicative of a rate of each of the musical tone piece data obtained by the division, to be reproduced, input by a second operating element, as well as a machine-readable storage medium containing a group of instructions for causing a machine to execute the slice method.

According to the fourth aspect of the present invention, musical tone pattern data stored in a first storage device is divided into a plurality of musical tone piece data based on division information selected, using a first manipulator, from plural types of division information stored in the second storage device, and the musical tone piece data obtained by the division are each reproduced by a length corresponding to rate information input using a second manipulator. That is, the musical tone piece data obtained by the division based on the division information which requires a small amount of data to be controlled are each reproduced by a length corresponding to the rate information, thus enabling new musical tone pattern data to be generated from previously generated musical tone pattern data in real time.

The above and other objects, features, and advantages of the invention will become more apparent from the following detailed description taken in conjunction with the accompanying drawings.

DETAILED DESCRIPTION

The present invention will be described below with reference to the drawings showing a preferred embodiment thereof.

Figure 1:
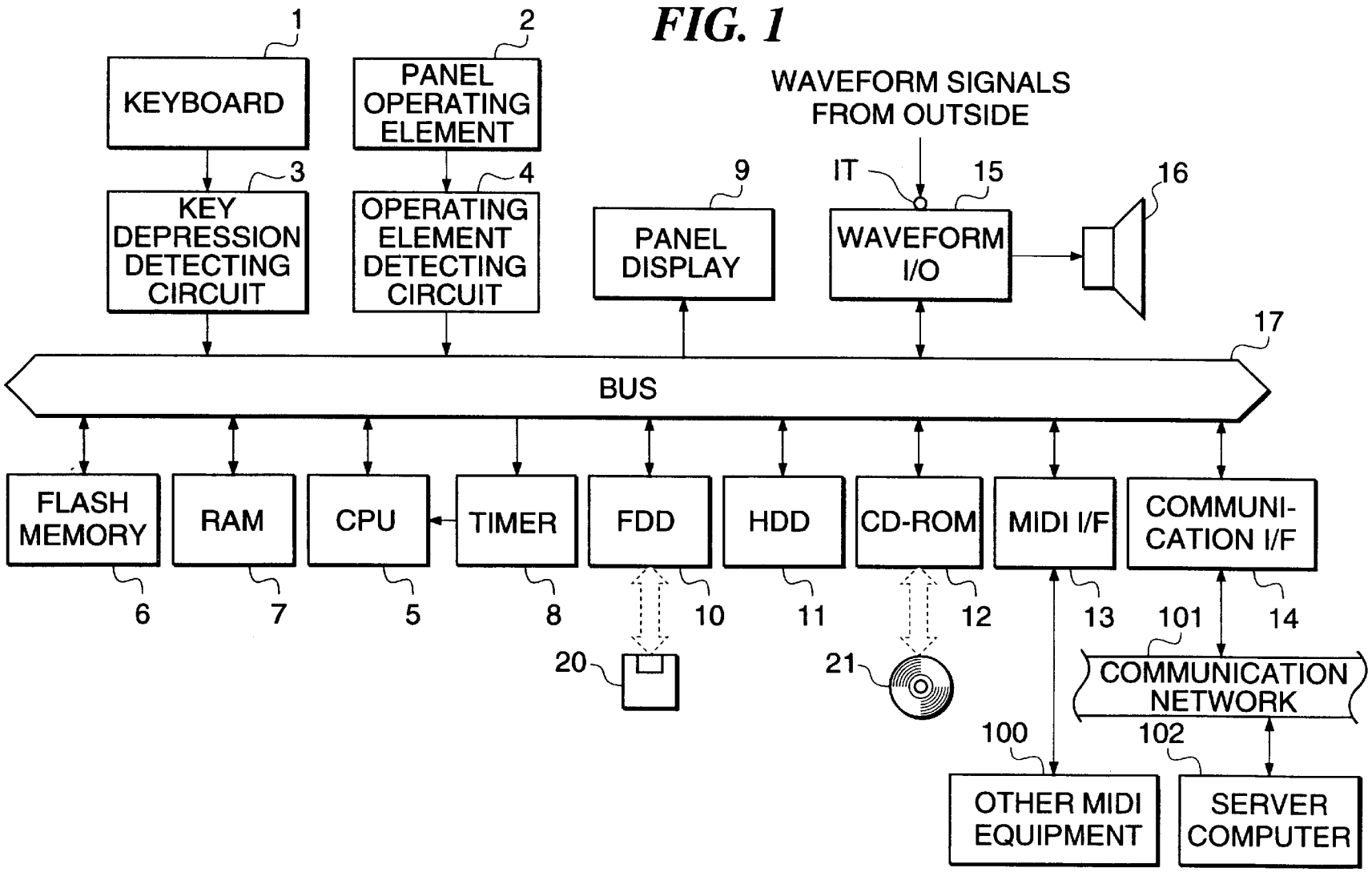
FIG. 1 is a block diagram schematically showing the construction of a remix apparatus according to an embodiment of the present invention.
Figure 2:
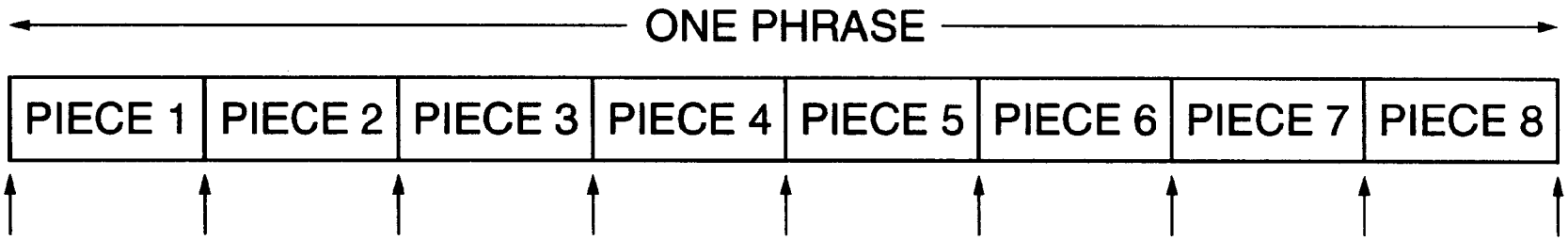
FIG. 2 is a view showing, by way of example, how selected musical tone pattern data is evenly divided into eight musical tone piece data.

FIG. 1 is a block diagram schematically showing the construction of a remix apparatus according to an embodiment of the present invention. The remix apparatus of the present embodiment executes a slice process in addition to a (loop) remix process as described later, but will be hereinafter referred to as "the remix apparatus" for convenience' sake.

As shown in FIG. 1, the remix apparatus of the present embodiment is comprised of a keyboard 1 for inputting pitch information, a panel operating element(manipulator) 2 provided with a plurality of operating elements for inputting various information, a key depression detecting circuit 3 for detecting the depressed state of each key of the keyboard 1, an operating element detecting circuit 4 for detecting the depressed state of each operating element of the panel operating element 2, a CPU 5 for controlling the entire apparatus, a flash memory 6 that stores control programs executed by the CPU 5, musical tone waveform data, various table data, and other data, a RAM 7 for temporarily storing performance data, various kinds of information, results of operations, and other data, a timer 8 for measuring a timer interrupting time in a timer interruption process and other times, a panel display 9 provided with, e.g., a liquid crystal display (LCD), and light emitting diodes or the like, a floppy disk drive (FDD) 10 for driving a floppy disk (FD) 20 as a storage medium, a hard disk drive (HDD) 11 for driving a hard disk, not shown, on which a variety of programs including the control programs, a variety of data, and other data, a CD-ROM drive (CD-ROMD) 12 for driving a compact disk read only memory (CD-ROM) on which a variety of application programs including the control programs, a variety of data, and other data can be stored, an MIDI interface (I/F) 13 for receiving musical instrument digital interface (MIDI) signals from the outside and outputting the MIDI signals to the outside, a communication interface (I/F) 14 for transmitting data to and from, e.g., a server computer 102 on a communication network 101, a waveform I/O 15 composed of an input terminal IT for inputting analog musical tone waveform signals from the outside, an analog-to-digital converter (ADC) for converting the analog musical tone waveform signals into digital musical tone waveform data, a digital-to-analog converter for converting digital musical tone waveform data into analog musical tone waveform signals, and others, and a sound system 16, for example, an amplifier and speakers, for converting the analog musical tone signals from the waveform I/O 15 into sounds.

The above-mentioned components 3 to 16 are interconnected through a bus 17. The timer 8 is connected to the CPU 5, another MIDI equipment 100 is connected to the MIDI I/F 13, the communication network 101 is connected to the communication I/F 14, and the sound system 16 is connected to the waveform I/O 15.

The waveform I/O 15 generates musical tone pattern data by receiving analog musical tone waveform signals (for example, musical tone waveform signals generated by a user by playing an instrument or reproduced by the user using a CD player, a record player, or various other players) through the internal terminal IT, causing the ADC to sample the input analog musical tone waveform signals, and storing the obtained sampling data in a sampling data storage area provided in the flash memory 6 or the RAM 7. At this time, the waveform I/O 15 generates header information automatically or in response to the user's instruction and adds the same to the musical tone pattern data at a leading position thereof. The header information contains the name of the musical tone pattern data, the sampling frequency, the number of bits, the pitch, the number of channels, and others. In the present embodiment, musical tone waveform signals, from which musical tone pattern data are generated, are analog signals, but these signals may be digital data. However, it goes without saying that the sampling by the ADC is not required for input digital musical tone waveform data.

The waveform I/O 15 also causes the DAC to convert new musical tone pattern data (digital data) generated by the loop remix process or slice process, described later, into analog data and transmits the obtained analog data to the following sound system 16.

More specifically, the waveform I/O 15 principally provides two types of functions: the function of sampling analog musical tone waveform signals, converting the obtained sampling data into digital musical tone waveform data, and storing the obtained digital data, and the function of converting digital musical tone waveform data generated by the loop remix process or slice process into analog musical tone waveform signals, and then transferring the obtained analog signals. The digital musical tone waveform data are generated exclusively by the CPU 5. That is, the present embodiment employs what is called a software sound source which generates digital musical tone waveform data by means of a software process executed by the CPU 5. Of course, the present invention is not limited to this and what is called a hardware sound source may be employed, which generates digital musical tone waveform data using dedicated hardware.

Although not illustrated, the panel operating element 2 includes eight pads and two control knobs. When the waveform I/O 15 samples analog musical tone waveform signals from the outside and stores the obtained sampling waveform data in the flash memory 6 or the RAM 7, the sampling waveform data are assigned to any of the pads. Then, the user operates one of the pads to read the sampling waveform data assigned to that pad for reproduction. The operation of the control knobs will be described later. It should be noted that the numbers of pads and control knobs are not limited to the above values and that the pads and control knobs may be replaced with other operating elements, insofar as they perform similar operations.

As stated above, the control programs executed by the CPU 5 can be stored in the hard disk of the HDD 11. In the case where the control programs are not stored in the flash memory, they can be stored in the hard disk so that they can be read into the RAM 7 and the CPU 5 can operate in the same manner as in the case where the control programs are stored in the flash memory 6. This facilitates the addition of new control programs and version upgrading of the control programs. Further, the HDD 11 may store waveform data for use by the software sound source (or the above-mentioned hardware sound source) as the sound source of the present invention to generate musical tone waveform data. In this case, the software sound source (or hardware sound source) reads the waveform data from the HDD 11 to a waveform data storage area or the like of the RAM 7 before generating digital musical tone waveform data.

The control programs and a variety of data are read from the CD-ROM 21 of the CD-ROM drive 12 and are stored in the hard disk of the HDD 11. This facilitates the installment of additional control programs and version upgrading of the control programs. An external storage device other than the CD-ROM drive 12 may be provided in order to use various kinds of media such as a magnetic optical disk.

The MIDI I/F 13 is not limited to a dedicated one but may be a universal interface such as RS-232C, USB (Universal Serial Bus), or IEEE 1394. In this case, data other than MIDI messages may be simultaneously transmitted or received.

As stated above, the communication I/F 14 is connected to the communication network 101 such as a local area network (LAN), the Internet, and a telephone line. The communication I/F 14 can connect to the server computer 102 via the communication network. In the case where a certain program or parameters are not stored in the hard disk of the HDD 11, the communication I/F 14 is used to download the program or the parameters from the server computer 102. A client computer (the remix apparatus in the present embodiment) transmits a command to the server computer 102 via the communication network 101 to request downloading of the program or the parameters. Responsive to the command, the server computer 102 transmits the requested program or the parameters to the client computer. The client computer receives the program or the parameters through the communication I/F 14 and stores them in the hard disk of the HDD 11 to complete the downloading. The remix apparatus may also be provided with an interface for transmitting and receiving data directly to and from an external computer or the like.

The remix apparatus may also be provided with an interface for transmitting and receiving data directly to and from an external computer or the like.

As is apparent from the above-mentioned construction, the remix apparatus of the present embodiment is constructed on a general purpose personal computer, but the present invention should not limited to this. The remix apparatus may also be constructed on a dedicated apparatus that is composed of minimum components required for embodying the present invention.

A control process executed by the remix apparatus constructed as described above will be explained in brief with reference to FIGS. 2 to 5 and then in detail with reference to FIGS. 6 to 9.

When the user operates one of the above-mentioned eight pads, the musical tone pattern data assigned to that pad is read out from the sampling data storage area of the flash memory 6 or the RAM 7 and is displayed, for example, on the above-mentioned panel display 9. When the user designates a part of the musical tone pattern data as one phrase, the CPU 5 evenly divides the data for one phrase into eight musical tone piece data and adds start addresses (the addresses of positions in FIG. 2 which are shown by the upward arrows) of the musical tone piece data obtained by the division to the-header information of the musical tone pattern data. In the present embodiment, the data for one phrase is designated as the musical tone pattern data, but the present invention is not limited to this. The data may be longer or shorter than one phrase. Moreover, the remix apparatus is constructed such that the musical tone pattern data is designated by the user as stated above, but the present invention is not limited to this. The CPU 5 may automatically designate the musical tone pattern data.

Then, by changing the order and/or manner of reading the musical tone piece data based on the start addresses, the loop remix process and the slice process are embodied as stated below. In the present embodiment, a loop remix mode for executing the loop remix process and a slide mode for executing the slice process are provided and switched to achieve the desired process.

(1) Loop Remix Process

Figure 3:
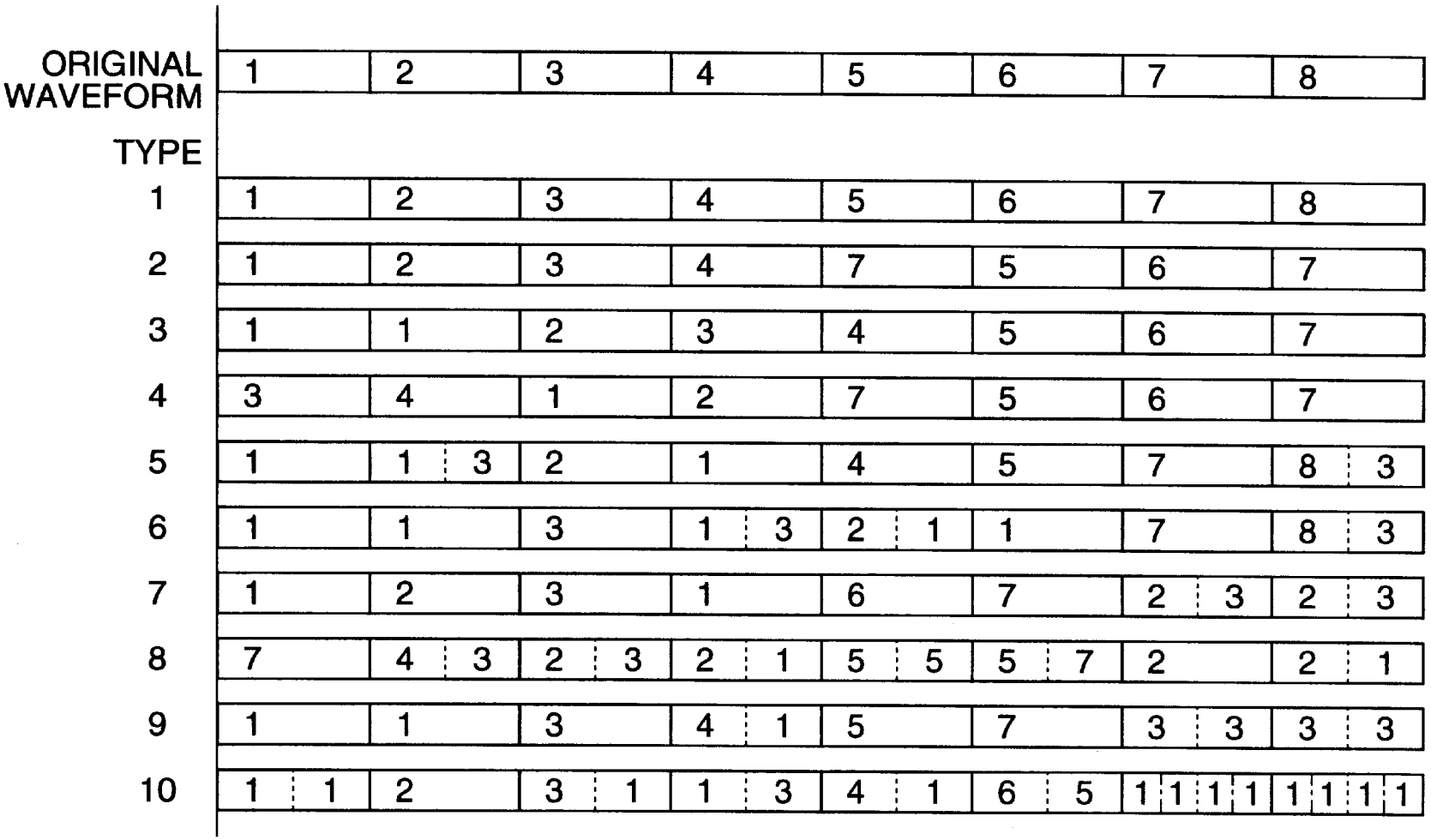
FIG. 3 is a view showing an example of types of orders in which the musical tone piece data are read out.

FIG. 3 is a view showing an example of types (TYPE) of orders in which the musical tone piece data are to be read out. Data (for example, in the case of TYPE=4, a sequence of 3, 4, 1, 2, 7, 5, 6, 7 (however, the integral values constituting the sequence are each indicative of the order of each of the plural musical tone piece data constituting the original musical tone pattern data (original waveform)) representative of these readout orders are stored in the above-mentioned flash memory 6 as table data. FIG. 3 illustrates an example of 10 types of different readout orders, i.e. TYPEs=1, 2, . . . , 10, which are arranged such that as the number set as the TYPE increases, the readout order becomes more complicated. The expression "more complicated", as used herein, means that the difference from the original readout order (TYPE=1) increases. For example, the more complicated order corresponds to an increase in the number of musical tone piece data the readout order of which has been changed from the original one, an increase in difference in readout order between the rearranged and original musical tone piece data, a decrease in the unit of the rearranged musical tone piece data, or a combination thereof. As the order becomes more complicated, the auditory difference from the original musical tone pattern data increases.

Further, at several places in FIG. 3, one musical tone piece data is divided into two or four pieces (the second data of TYPE=5, the fourth data of TYPE=6, and others). This indicates that during one-piece readout period, the musical tone piece data to be selected and reproduced is changed from one to another during reproduction.

Figure 4:
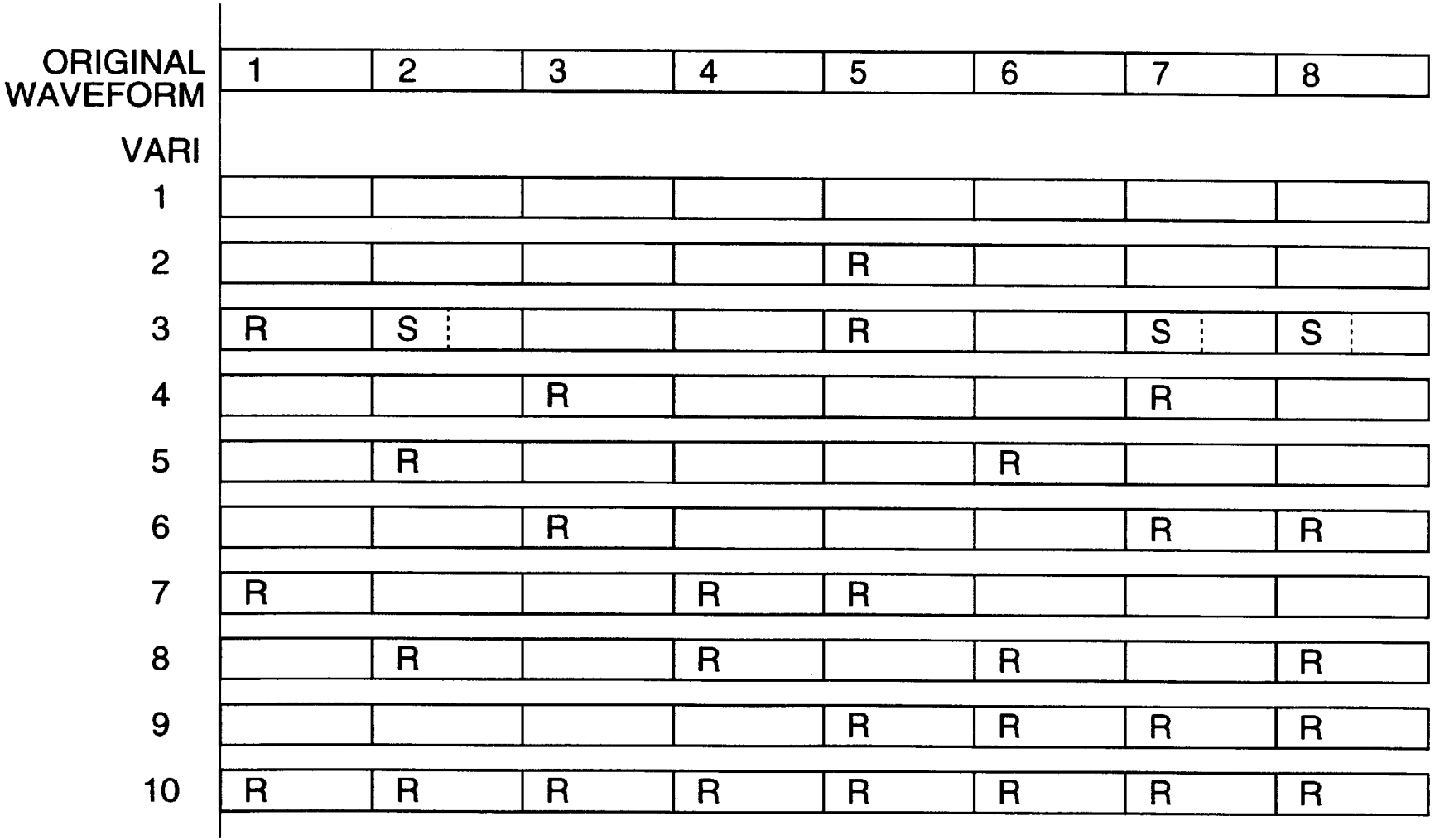
FIG. 4 is a view showing an example of variations of manners in which the musical tone piece data are read out.

FIG. 4 is a view showing an example of variations (VARI) of manners of reading musical tone piece data. Data representative of these readout manners are stored in the flash memory 6 as table data (for example, in the case of VARI=3, correlation data for correlating a readout manner (R, S) of R: 1, 5; S: 2, 7, 8 with orders in which the musical tone piece data constituting the original musical tone pattern data are to be read out in that readout manner, where "R" means that the musical tone piece data is to be read out in a reverse direction, that is, from its end address to its start address, "S" means that a part of the musical tone piece data located between its start address and its central address is not to be read out, that is, this part corresponds to silence, and each numerical value is indicative of the order of each of the plural musical tone piece data constituting the original musical tone pattern data (original waveform)). FIG. 4 illustrates an example of 10 types of different variations of readout manners including VARIs=1, 2, . . . , 10, which are arranged such that as the number set as the VARI increases, the readout manner becomes more complicated. The expression "more complicated", as used herein, means that the difference from the original readout manner (VARI=1) increases. For example, the more complicated manner corresponds to an increase in the number of musical tone piece data read out in the reverse order. Here, only "reverse" and "silence" are illustrated as special readout manners, but manner control such as "applying effects such as distortion", "reducing the sampling frequency for low fidelity", or "varying the volume or pitch" may be provided for each musical tone piece data.

The user uses one of the two control knobs to designate a type of readout order, while using the other to designate a variation of readout manner. A description will be given of how to designate the type of readout order and the variation of readout manner. When the user selects, for example, the loop remix mode, the panel display 9 displays lists of the types of readout order and the variations of readout manner shown in FIGS. 3 and 4, respectively. The user then rotates each of the two control knobs to designate the desired type of readout order and the target variation of readout manner.

When the user operates one of the pads, the musical tone pattern data assigned to that pad is selected and the selected musical tone pattern data is subsequently repeatedly reproduced. At this time, new musical tone pattern data is generated and reproduced depending on the selected type of readout order and the selected variation of readout manner. The present invention is characterized by accepting instructions for changing the type of readout order and the variation of readout manner as provided by the two control knobs. The thus accepted change instructions become effective when the reproduction of the current musical tone pattern data is completed and is then started again (what is called "loop reproduction"). Then, the loop reproduction is started in accordance with changes in the type of readout order and in the variation of readout manner which have been instructed during the reproduction of the musical tone pattern data; that is, the loop remix process is executed in real time. The reason why such a real-time loop remix process can be achieved is that the remix process is executed using pointers (the pointers to the start addresses) which require a small amount of data to be controlled compared to the conventional remix apparatus.

(2) Slice Process

Figure 5:
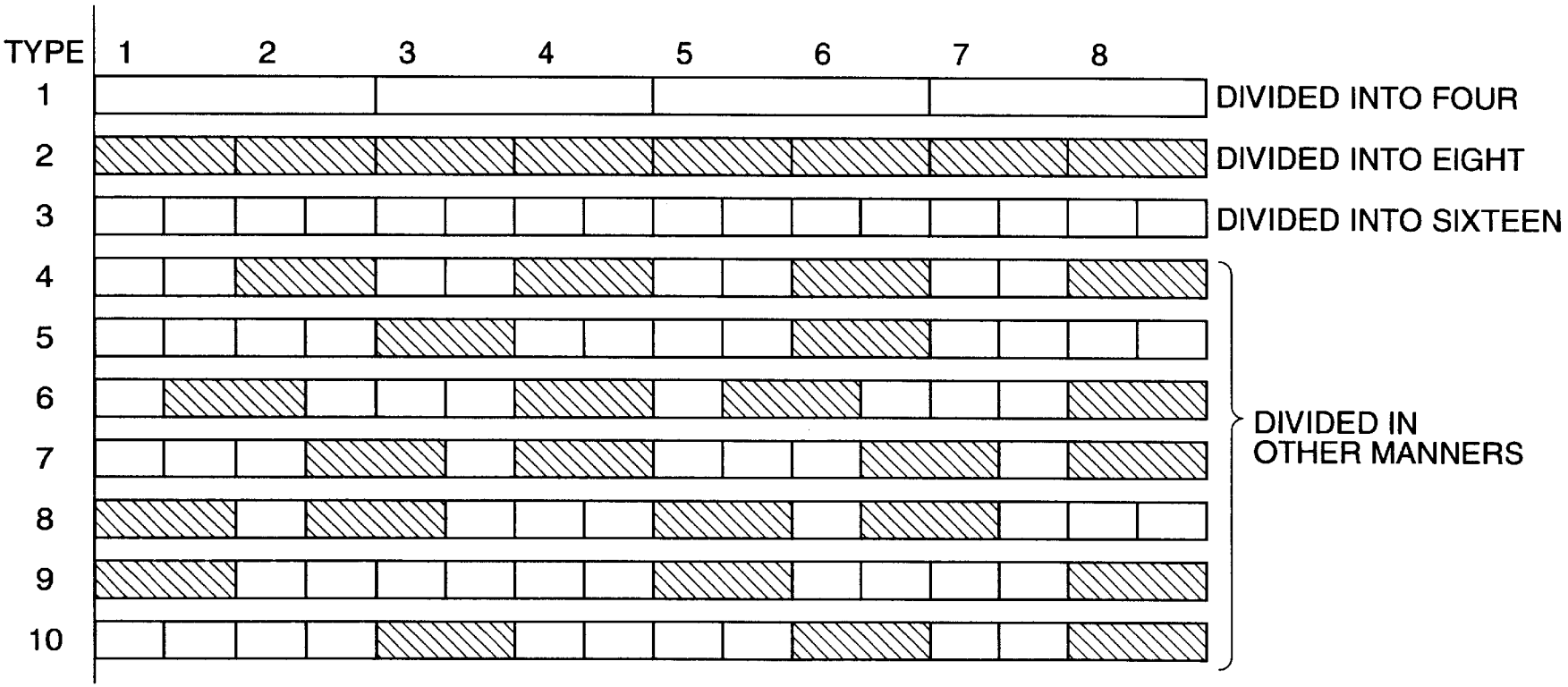
FIG. 5 is a view showing an example of division types used for dividing musical tone pattern data for one phrase into a plurality of musical tone piece data, for a slice process.

FIG. 5 is a view showing an example of division types (TYPE) used for dividing musical tone pattern data for one phrase into a plurality of musical tone piece data for a slice process. Data representative of division manners (areas of musical tone piece data obtained by the division) are stored in the above-mentioned flash memory 6 as table data (for example, in the case of TYPE=4, a sequence of 0.5, 0.5, 1, 0.5, 0.5, 1, 0.5, 0.5, 1, 0.5, 0.5, 1 (however, the numerical values constituting the sequence are each indicative of the ratio of the the length of each musical tone piece data obtained when one-eighth of a phrase is used as a unit length ("1")). FIG. 5 illustrates an example of 10 types of different piece areas, i.e. TYPEs=1, 2, . . . , 10, which are arranged such that as the number set as the TYPE increases, the piece areas become more complicated. In the figure, the shaded portions simply show unit length areas and have no further meaning.

The user uses one of the above-mentioned control knobs to designate a type of piece areas. A description will be given of how to designate the type of piece areas. When the user selects, for example, the slice mode, the panel display 9 displays a list of piece areas, shown in FIG. 5. The user then rotates that control knob to designate the desired type of piece areas.

Further, the other of the two control knobs is used to designate the rate of a partial area of each of the piece areas of the designated type that is to be reproduced (hereinafter referred to as "the RATE value"). More specifically, as the control knob is rotated in a predetermined direction, the rate is set in a direction in which the length of the partial area of the piece area to be reproduced becomes closer to the length of this piece area (piece area length). On the other hand, as the control knob is rotated in the reverse direction, the rate is set in a direction in which the length of the partial area of the piece area to be reproduced becomes closer to zero.

When the user operates one of the pads, the musical tone pattern data assigned to that pad is selected and the selected musical tone pattern data is subsequently repeatedly reproduced. At this time, new musical tone pattern data (slice pattern data) is generated and reproduced depending on the designated type of piece areas and the designated rate of the partial area to be reproduced. The present invention is characterized by accepting instructions for changing the type of piece areas and the rate of the partial area to be reproduced as provided by the two control knobs. The thus accepted change instructions become effective when the loop reproduction is started. Then, the loop reproduction is started in accordance with changes in the type of piece areas and in the rate of the reproduced partial area which have been instructed during the reproduction of the musical tone pattern data; that is, the slice process is executed in real time. The reason why such a real-time slice process can be achieved is that the slice process is executed using pointers (the pointers to the start addresses) which require a small amount of data to be controlled compared to the conventional slice apparatus.

Next, the loop remix process and the slice process will be described in detail.

Figure 6:
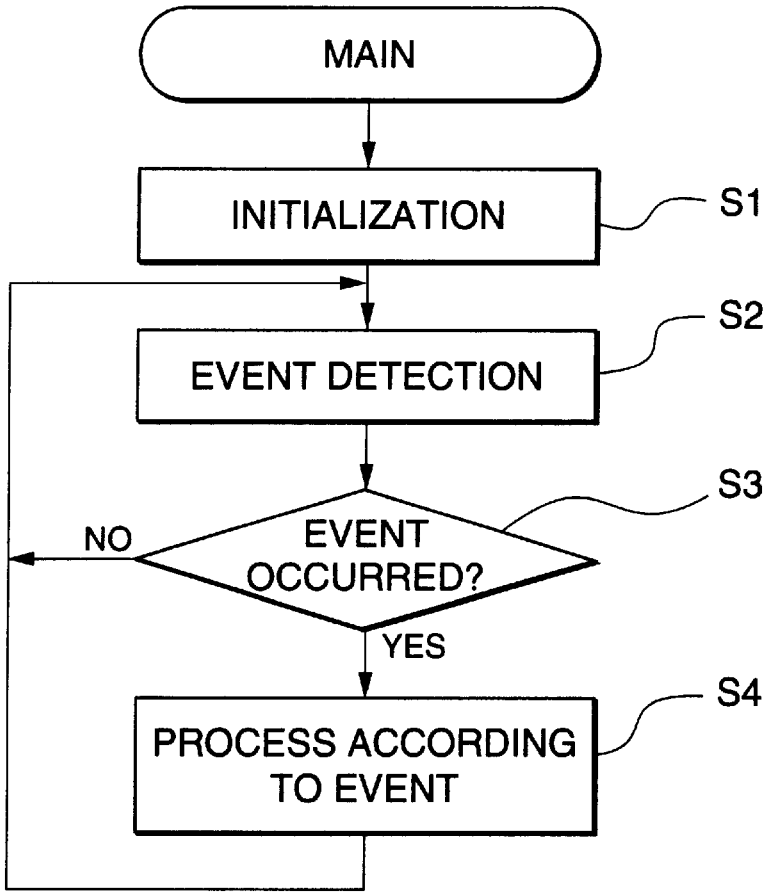
FIG. 6 is a flow chart showing the procedure of a main routine executed by the remix apparatus in FIG. 1, particularly, a CPU.

FIG. 6 is a flow chart showing the procedure of a main routine executed by the remix apparatus of the present embodiment, particularly the CPU 5.

In the figure, initialization is executed; that is, the RAM 7 is cleared, various ports are reset, a default tempo is set, etc. (step S1).

Then, event detection is executed (step S2). When an event is detected, a process is executed according to that event (step S3) and the process then returns to the step S2. On the other hand, when no event is detected, the process directly returns to the step S2. That is, once the initialization at the step S2 is completed, a loop process consisting of the steps S2, S3, and S2 executed in this order or a loop process consisting o the steps S2, S3, S4, and S2 executed in this order is repeatedly carried out.

In the present embodiment, the entire loop process is executed as a multitask operation, so that even while the detected event is being processed at the step S4, the next event detecting process, that is, the processing at the step S2 is executed in parallel with the processing of the event.

Figure 7:
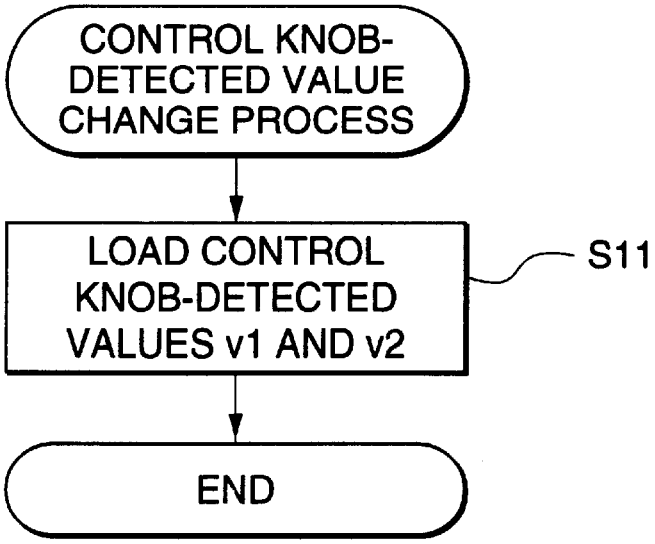
FIG. 7 is a flow chart showing the procedure of a control knob-detected value change process.

FIG. 7 is a flow chart showing the procedure of a control knob-detected value change process. This process is a part of the process executed according to the detected event at the step S4 and is actuated according to, the event generated when at least one of the two control knobs is rotated.

In FIG. 7, the amounts of operations of the control knobs are detected, and the detected values are loaded into areas v1 and v2, respectively, provided at predetermined locations in the RAM 7 (the contents of the areas v1 and v2 will be hereinafter referred to as "the control knob operation amount v1" and "the control knob operation amount v2", respectively) (step S11), followed by completing this process.

Figure 8:
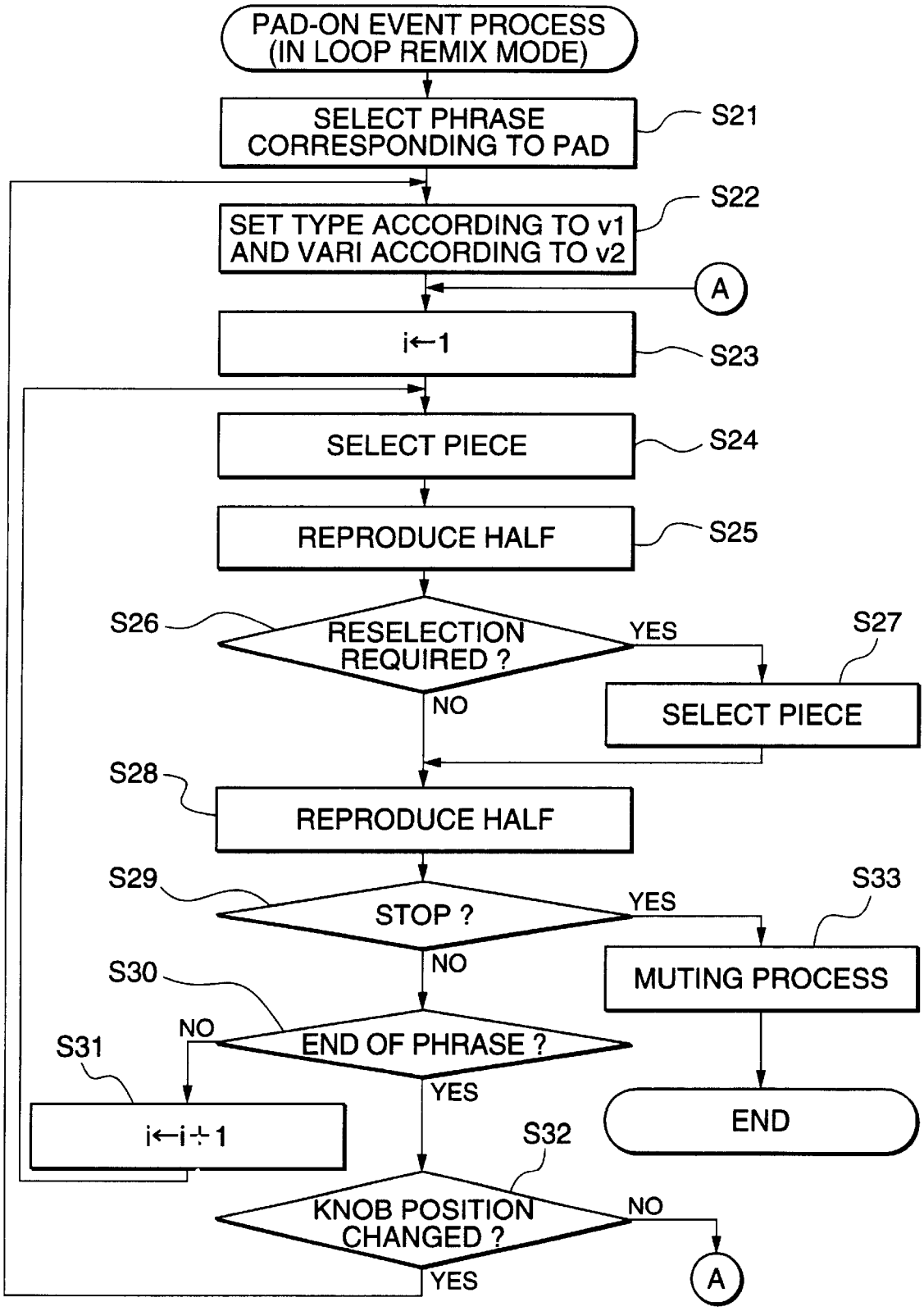
FIG. 8 is a flow chart showing the procedure of a pad-on event process in a loop remix mode.

FIG. 8 is a flow chart showing the procedure of a pad-on event process executed in the loop remix mode. This process is also a part of the process executed according to the detected event at the step S4 and is actuated in response to a pad-on event generated when the user operates one of the eight pads.

In FIG. 8, first, a phrase corresponding to the operated pad, that is, musical tone pattern data is selected (step S21).

Next, the type (TYPE) of readout order of the musical tone piece data as described with reference to FIG. 3 is set according to the control knob operation amount v1, and the variation (VARI) of readout manner of the musical tone piece data as described with reference to FIG. 4 is set according to the control knob operation amount v2 (step S22). More specifically, one of the values from "1" to "10" is set in an area TYPE (the contents of this area will be hereinafter referred to as "the TYPE value") according to the control knob operation amount v1, and one of the values from "1" to "10" is set in an area VARI (the contents of this area will be hereinafter referred to as "the VARI value") according to the control knob operation amount v2.

Then, an index i indicative of one of the piece ranges 1 to 8 of the data representative of the readout order (FIG. 3) or of the data representative of the readout manner (FIG. 4) is initialized (is←1) to specify a first piece (step S23). Then, musical tone piece data is selected, which is indicated by the data of the piece range indicated by the index i, from the data representative of the readout order corresponding to the TYPE value set at the step S22 (step S24). Specifically, the selection is made by simply pointing a readout pointer (for example, formed by software) for reading out musical tone pattern data to the start address of the musical tone piece data (if the i-th piece range of the data representative of the readout manner indicated by the VARI value is indicative of reproduction in a positive direction) or the end address of the same (if the i-th piece range is indicative of reproduction in the reverse direction).

Then, a half length of the selected musical tone piece data is reproduced (step S24). This reproduction of the musical tone piece data is carried out from the position of the readout pointer set at the step S24 while moving the readout pointer forward, according to the readout manner indicated by the data of the piece range designated by the index i, which data is contained in the data representative of the readout manner corresponding to the VARI value. More specifically, if, for example, TYPE=5 and VARI=3, and i=1, then the readout pointer is pointed to the end address of the fist musical tone piece data and a half length of the musical tone piece data is reproduced in the reverse direction from that address location, that is, toward the start address of the musical tone piece data.

Next, it is determined whether or not reselection is required (step S26). The reselection is required if the data of the i-th piece range of the data representative of the readout order designated by the TYPE value is divided into two pieces of data, i.e. a former half and a latter half which designate respective different musical tone piece data, that is, if the second or eighth musical tone piece data is to be reproduced when TYPE=5. If it is determined at the step S26 that the reselection is required, the musical tone piece data designated by the latter half of the piece range is selected similarly to the step S27, and the process then proceeds to a step S28. When the reselection is not required, the process proceeds directly to the step S28.

At the step S28, similarly to the step S25, a half length of the reselected musical tone piece data is reproduced from the position of the readout pointer set at the step S27, according to the readout manner indicated by the data of the piece range designated by the index i, which data is contained in the data representative of the readout manner corresponding to the VARI value. A half length of the non-reselected musical tone piece data is reproduced from the position of the readout pointer which is assumed at the time of completion of the reproduction executed at the step S25, according to the readout manner indicated by the data of the piece range designated by the index i, which data is contained in the data representative of the readout manner corresponding to the VARI value. The process of reselecting the musical tone piece data at the step S27 is carried out only by resetting the readout pointer and the processing in the step S28 is common to the reselected and non-reselected musical tone piece data.

Then, it is determined whether a stop switch, not shown, of the panel operating element 2 has been operated to instruct the pad-on event process to be stopped (step S29). If the stop switch has not been operated, it is determined whether or not the musical tone piece data has been reproduced up to the phrase end (step S30). In the present embodiment, this determination corresponds to determining whether or not the piece range indicated by the index i has reached the final piece range (i=8). If it is determined at the step S30 that the musical tone piece data has not been reproduced up to the phrase end, that is, i≠8, then the index i is incremented by "1" and the process returns to the step S24 to repeat the processing from the step 24 to the step 30. On the other hand, when the musical tone piece data has been reproduced up to the phrase end, that is, i=8, it is determined whether or not at least one of the two control knobs has its position changed during the processing from the step S22 to the step S31 (step S32).

When it is determined at the step S32 that at least one of the two control knobs has its position changed, the process returns to the step S22 to reset the TYPE and VARI values to thereby carry out a loop readout based on these reset values. When it is determined that neither of the two control knobs has its position changed, the process returns to the step S23 to carry out a loop readout again based on the currently set TYPE and VARI values.

On the other hand, when it is determined at the step S29 that the stop switch has been operated, the musical tone being currently produced is muted (step S33), followed by completing the pad-on event process.

Figure 9:
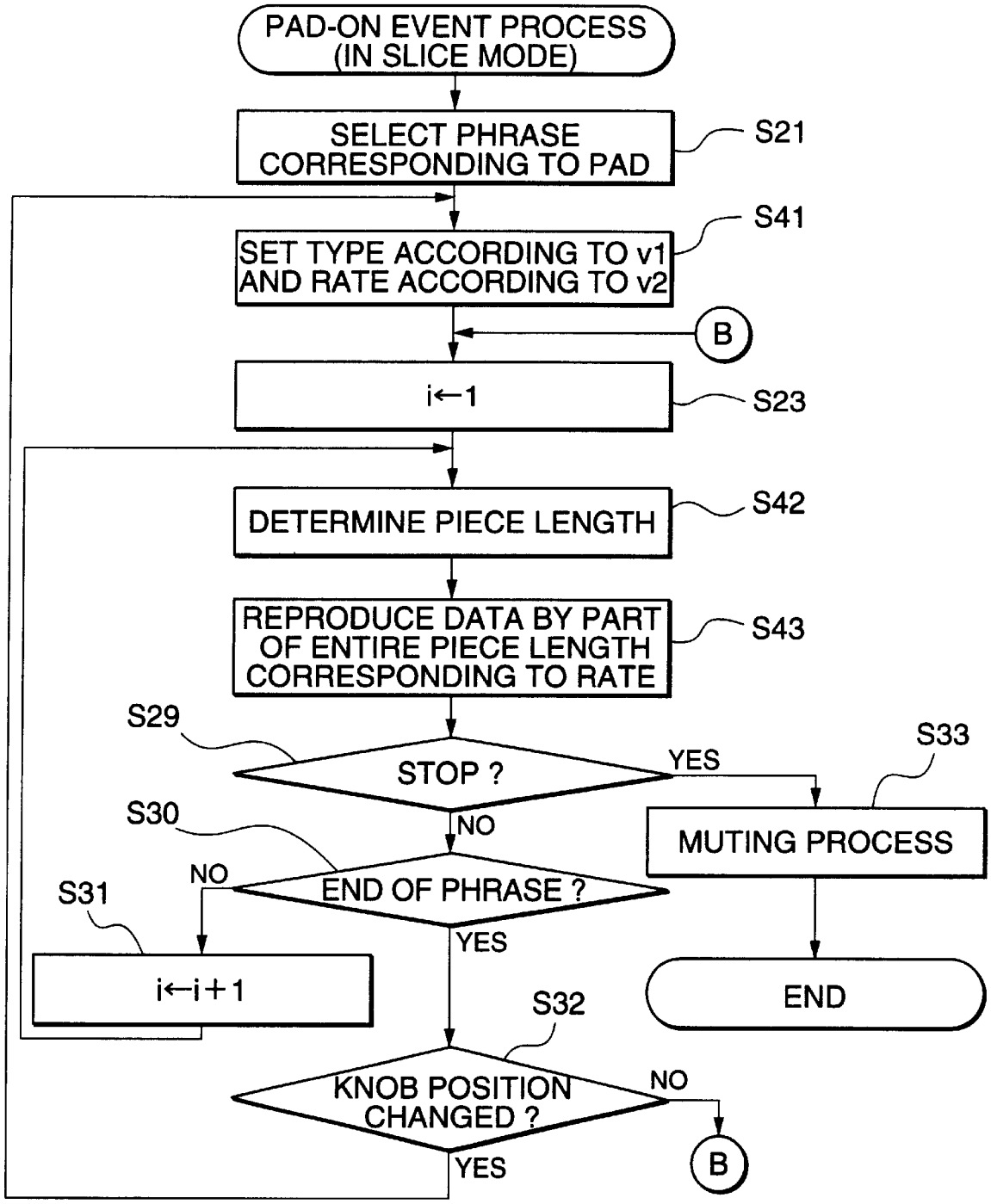
FIG. 9 is a flow chart showing the procedure of a pad-on event process in a slice mode.

FIG. 9 is a flow chart showing the procedure of the pad-on event process executed in the slice mode. This process is also a part of the process executed according to the event detected at the step S4 and is actuated in response to a pad-on event generated when the user operates one of the eight pads with the slice mode selected. This pad-on event process can be embodied by partly changing the procedure of the pad-on event process executed in the loop remix mode in FIG. 8. Thus, steps in FIG. 9 which execute processing similar to that in FIG. 8 are denoted by the same step numbers and description thereof is omitted.

In FIG. 9, a phrase corresponding to the selected pad is selected as in the step S21 in FIG. 8.

Then, the type (TYPE) designating one of the data representative of the plural area division manners (the areas of the musical tone piece data obtained by the division) of dividing the musical tone pattern data as described with reference to FIG. 5 is set according to the control knob operation amount v1, and the RATE value (in percentage, for example) is set according to the control knob operation amount v2 (step S41). Further, the index i designating one of the plural piece areas of the data representative of the division manner corresponding to the set type (TYPE) is initialized (i←1) to specify a first piece area (step S23).

Then, the piece length of the piece area indicated by the index i is obtained from the plural piece areas of the data representative of the division manner corresponding to the set TYPE value and is set as the piece length of the musical tone piece data to be reproduced next (step S42). Specifically, for example, if TYPE=5 and i=1 to 4, then the piece length is set to ½, and if i=5, then the piece length is set to 1.

Then, a part of the total piece length which corresponds to the RATE value is reproduced (step S43). More specifically, with TYPE=5, RATE=50% and i=1, then a former quarter of the first musical tone piece data having a half length is reproduced, whereas a latter quarter of the first musical tone piece data is not reproduced, which thus remains silent (only the time is counted). With i=2, only a former quarter of the second musical tone piece data having a half length is reproduced, whereas a latter quarter of the same remains silent. Thereafter, reproduction corresponding to i=3 and 4 is similarly carried out, and then with i=5, a former half of the fifth musical tone piece data having one length is reproduced, whereas a latter half of the same remains silent. Subsequently, each of the remaining musical tone piece data obtained by the division based on the division manner corresponding to the TYPE value is first reproduced from its leading position up to the position corresponding to the rate indicated by the RATE value, while the remaining part of the length of the musical tone piece data remains silent. Here, only the case of a RATE value of 50% has been described, but the RATE value may be varied between 0 and 100% according to the control knob operation amount v2. If, for example, the RATE value is 40%, former two-fifths of each of the plural musical tone piece data obtained by the division is reproduced, with the remaining three-fifths remaining silent.

In the present embodiment, as the musical tone pattern data, sampling waveform data obtained by sampling by the waveform I/O 15 is used, but the present invention is not limited to this. The musical tone pattern data may be automatic performance data such as MIDI data, or musical tone waveform data such as sine or sawtooth wave, which are used to generate musical tones.

In the present embodiment, not only the slice process but also the loop mix process are configured such that the information indicative of the readout order includes no accidental element, but the present invention is not limited to this. These processes may be configured such that a part (or the whole) of the information indicative of the readout order includes accidental element(s). Specifically, for example, random numbers may be generated so that the musical tone piece data can be selected based on these numbers.

The above given description of the present embodiment is focused on one musical tone pattern data repeatedly reproduced according to the operation of the pads, but this is for the convenience of explanation only. In general, if a plurality of pads are continuously operated, as many musical tone pattern data are simultaneously reproduced. For the plurality of simultaneously reproduced musical tone pattern data, each of the data is desirably independently controlled using two control knobs. To achieve this, two control knobs may be provided correspondingly to each of the plural pads. This, however, may lead to a complicated structure. The number of control knobs may be reduced by executing control using the two control knobs only on the musical tone pattern data obtained using the last operated pad, while retaining, for the other pads, the operation amounts v1 and v2 of the two control knobs applied at the time of the last execution of the control using the two control knobs so that the control is executed based on the retained values. According to this method, control which corresponds to the control knob operation amounts can be simultaneously executed in an independent manner for each pad, using a small number of control knobs.

Further, each of the plural modes may be controlled to be turned on and off so that these modes can be simultaneously executed. That is, instead of using the selection method of selecting only one of "the loop remix mode" and "the slice mode" as described above with respect to the present embodiment, each mode may be turned on and off. This enables the special effects of "the loop remix mode" to be superposed on the special effects of "the slice mode". In this case, if the two control knobs are independently provided for each mode, each mode can be independently controlled without adding any modification to the construction. The provision of the control knobs for each mode, however, may lead to a complicated structure. The number of control knobs may be reduced by retaining the control knob operation amounts v1 and v2 for each mode applied when the mode is turned off so that when the same mode is subsequently turned on, control is executed based on the retained control knob operation amounts irrespective of the current values. When the control knobs are subsequently operated, control based on the detected control knob operation amounts v1 and v2 is executed only for the last turned-on mode. According to this method, control which corresponds to the control knob operation amounts can be simultaneously executed in an independent manner for each mode, using a small number of control knobs It goes without saying that the object of the present invention can be achieved by providing a system or an apparatus with a storage medium containing a software program code for realizing the functions of the above-described embodiment and reading the program code from the storage medium by a computer (or the CPU 5 and the MPU) of the system or apparatus for execution.

In this case, the program code itself read from the storage medium realizes the novel functions of the present invention, and the storage medium containing the program code constitutes the present invention.

Examples of the storage medium containing the program code are the floppy disk 20, a hard disk, an optical disk, a magneto optical disk, the CR-ROM 21, a CD-R, a magnetic tape, a non-volatile memory card, and the flash memory 6. Alternatively, the program code may be supplied from the server computer 102 through the MIDI equipment 100 and the communication network 101.

Of course, the functions of the above-described embodiment can be realized not only by executing the program code read by means of the computer but also by executing a part or the whole of the actual processing by means of an operating system or the like working on the computer in accordance with commands of the program code.

Moreover, it goes without saying that the functions of the above-described embodiment can be realized by executing a part or the whole of the actual processing by means of the CPU 5 provided in a function expansion board inserted in the computer or a function expansion unit connected to the computer in accordance with commands of the program code after the program code read from the storage medium is written to a memory provided in the function expansion board or the function expansion unit.

What is claimed is:

1. A remix apparatus comprising:

a first storage device that stores musical tone pattern data of a predetermined length;

a dividing device that divides the stored musical tone pattern data of the predetermined length into a plurality of musical tone piece data of a length smaller than the predetermined length;

a second storage device that stores location information indicative of locations in said first storage device where the musical tone piece data obtained by the division are stored;

a third storage device that stores a plurality of types of rearrangement information indicative of readout order in which plurality of said musical tone piece data obtained by the division are to be read out;

an operating element device that allows a user to select a first rearrangement information from the stored plurality of types of rearrangement information;

a supplying device that supplies the location information corresponding to said musical tone piece data in first readout order indicated by the first rearrangement information; and a reproducing device that sequentially reproduces the musical tone piece data corresponding to the supplied location information in the first readout order, wherein while said reproducing device is reproducing said musical tone piece data in the first readout order, if said operating element device selects second rearrangement information from the stored plurality of types of rearrangement information, said supplying device stops supplying the location information corresponding to said musical tone piece data in the first readout order, and starts to supply the location information corresponding to said musical tone piece data in a second readout order indicated by the second rearrangement information, and wherein said reproducting device changes the readout order from the first readout order to the second readout order and continues reproducting the musical tone piece data corresponding to the supplied location information.

2. A remix apparatus according to claim 1, further comprising a control information generating device that generates control information for controlling a reproduction manner of reproducing said musical tone piece data by said reproducing device, and a control device that controls said reproduction manner according to the generated control information.

3. A remix apparatus according to claim 2, wherein said control information comprises information for carrying out reverse direction reproduction of specific musical tone piece data among the plurality of musical tone piece data.

4. A remix apparatus according to claim 2, wherein said control information comprises information for not reproducing specific musical tone piece data among the plurality of musical tone piece data.

5. A remix apparatus according to claim 2, wherein said control information comprises information for applying at least one predetermined effect to specific musical tone piece data among the plurality of musical tone piece data.

6. A remix apparatus according to claim 2, wherein said control information comprises information for carrying out a low fidelity process on specific musical tone piece data among the plurality of musical tone piece data.

7. A remix apparatus according to claim 2, wherein said control information comprises information for changing at least one of volume and pitch of specific musical tone piece data among the plurality of musical tone piece data.

8. A remix apparatus according to claim 1, wherein said operating element device is operable in a plurality of directions, said operating element device selecting rearrangement information indicative of a more complicated rearrangement of the musical tone piece data as said operating element device is operated in a first direction among the plurality of directions, and selecting rearrangement information indicative of a less complicated rearrangement of the musical tone piece data as said operating element device is operated in a second direction among the plurality of directions.

9. A remix apparatus according to claim 1, further comprising a fourth storage device that stores a plurality of types of reproduction control information to be selected by the user, wherein said reproducing device controls a reproduction manner of reproducing the musical tone piece data based on one of reproduction control information selected by the user.

10. A remix apparatus according to claim 1, wherein said supplying device is capable of supplying the location information corresponding to the plurality of the musical tone piece data while said reproducing device is reproducing the musical tone piece data.

11. A remix/slice apparatus comprising:

a storage device that stores musical tone predetermined pattern data of a predetermined length;

a reproducing device that reproduces the stored musical tone pattern data in a manner such that when reproduction of the stored musical tone pattern data proceeds to a trailing position of the musical tone pattern data, it is returned to a leading position of the musical tone pattern data to continue reproduction;

an operating element device that is operated by a user;

an accepting device that accepts operating element information generated by a user by operating said operating element device at an intermediate position between the leading position and the trailing position of the musical tone pattern data when the reproduction of the musical tone pattern data stored in the storage device is being carried out at said intermediate position between the leading position and the trailing position of the musical tone pattern data;

a control information generating device that generates control information for controlling a manner of said reproduction based on the accepted operating element information, in timing when the reproduction returns to the leading position of the musical tone pattern data upon proceeding to the trailing position thereof; and a control device that controls the manner of said reproduction based on the generated control information.

12. A remix/slice apparatus according to claim 11, further comprising a dividing device that divides the stored musical tone pattern data of the predetermined length into a plurality of musical tone piece data of a length smaller than the predetermined length, wherein said reproducing device reproduces each of the divided musical tone piece data, and wherein the control information comprises information for controlling rearrangement of the musical tone piece data.

13. A remix apparatus comprising:

a first storage device that stores musical tone pattern data of a predetermined length;

a dividing device that divides the stored musical tone pattern data of the predetermined length into a plurality of musical tone piece data of a length smaller than the predetermined length;

a second storage device that stores location information indicative of locations in said first storage device where the musical tone piece data obtained by the division are stored;

a third storage device that stores a plurality of types of rearrangement information indicative of readout order in which said plurality of musical tone piece data obtained by the division are to be read out;

a supplying device that supplies the location information corresponding to said musical tone piece data such that said musical tone piece data are rearranged a readout order indicated by one rearrangement information selected from said plurality of types of stored rearrangement information;

a reproducing device that sequentially reproduces the musical tone piece data in an order indicated by the supplied location information in a manner such that when reproduction of the musical tone piece data proceeds to a trailing position of the musical tone pattern data, it is returned to a leading position of the musical tone pattern data to continue reproduction;

an operating element device that outputs operation data according to operation of the user;

an accepting device that accepts the operation data outputted from said operating element device at an intermediate position between the leading position and the trailing position of the musical tone pattern data when the reproduction of the musical tone piece data is being carried out by said reproducing device at said intermediate position between the leading position and the trailing position of the musical tone pattern data; and a selecting device that selects one rearrangement information from said plurality of types of stored rearrangement information according to the accepted operation data, in timing when the reproduction of the musical tone piece data by said reproducing device proceeds to the trailing position of the musical tone pattern data and is returned to the leading position of the musical tone pattern data, the selected one rearrangement information being used to control the readout order of the location information supplied by said supplying device.

14. A slice apparatus comprising:

a first storage device that stores musical tone pattern data of a predetermined length;

a second storage device that stores a plurality of types of division information for dividing the stored musical tone pattern data of the predetermined length into a plurality of musical tone piece data of a length smaller than the predetermined length;

a first operating element that selects first division information from the stored plurality of types of division information;

a dividing device that divides the stored musical tone pattern data of the predetermined length into the plurality of musical tone piece data based on the first division information selected by said first operating element;

a second operating element that inputs rate information indicative of a rate of each of the musical tone piece data obtained by the division, to be reproduced; and a reproducing device that reproduces each of the musical tone piece data by a length corresponding to the rate information input by said second operating element, wherein while said reproducing device is reproducing the musical tone piece data, if said first operating element selects a second division information from the stored plurality of type of division information, said dividing device divides the stored musical tone pattern data of the predetermined length into a plurality of musical tone piece data based on the second division information selected by said first operating element, whereby said reproducing device reproduces each of the musical tone piece data divided based on the second division information, and wherein while said reproducing device is reproducing the musical tone piece data, if said second operating element inputs a second rate information indicative of a rate of each of the musical tone piece data obtained by the division, to be reproduced, said reproducing device reproduces each of the musical tone piece data by a length corresponding to the second rate information inputted by said second operating element.

15. A slice apparatus according to claim 14, wherein said reproducing device reproduces each of the musical tone piece data for a time period corresponding to a rate indicated by the first rate information, out of a reproducing period of each of the musical tone piece data, and wherein each of the musical tone piece data is not reproduced for a remaining time period of the reproduction period thereof.

16. A slice apparatus according to claim 14, wherein at least two musical tone piece data differs among the plurality of musical tone piece data divided by said dividing device have different lengths from each other.

17. A remix method comprising:

a first storing step of storing musical tone pattern data of a predetermined length in a first storage device;

a dividing step of dividing the stored musical tone pattern data of the predetermined length into a plurality of musical tone piece data of a length smaller than the predetermined length;

a second storing step of storing in a second storage device location information indicative of locations in said first storage device where the musical tone piece data obtained by the division are stored;

a third storing step of storing in a third storage device a plurality of types of rearrangement information indicative of readout order in which said plurality of musical tone piece data obtained by the division are to be read out;

a supplying step of supplying the location information corresponding to said musical tone piece data in first readout order indicated by a first rearrangement information so as to allow a user to select the first rearrangement information from amongst the stored plurality of types of rearrangement information; and a reproducing step of sequentially reproducing the musical tone piece data corresponding to the supplied location information in the first readout order, wherein while said reproducing step is reproducing said musical tone piece data in the first readout order, if said user selects a second rearrangement information from the stored plurality of types of rearrangement information, said supplying step stops supplying the location information corresponding to said musical tone piece data in the first readout order, and starts to supply the location information corresponding to said musical tone piece data in a second readout order indicated by the second rearrangement information, whereby said reproducing step changes the readout order from the first readout order to the second readout order and continues reproducing the musical tone piece data corresponding to the supplied location information.

18. A remix/slicing method comprising:

a storing step of storing predetermined musical tone pattern data of a predetermined length in a storage device;

a reproducing step of reproducing the stored musical tone pattern data in a manner such that when reproduction of the stored musical tone pattern data proceeds to a trailing position of the musical tone pattern data, it is returned to a leading position of the musical tone pattern data to continue reproduction;

an accepting step of accepts operating element information generated by a user by operating an operating element device at an intermediate position between the leading position and the trailing position of the musical tone pattern data when the reproduction of the musical tone pattern data stored in the storage device is being carried out at said intermediate position between the leading position and the trailing position of the musical tone pattern data;

a control information generating step of generating control information for controlling a manner of said reproduction based on the accepted operating element information, in timing when the reproduction returns to the leading position of the musical tone pattern data upon proceeding to the trailing position thereof; and a control step of controlling the manner of said reproduction based on the generated control information.

19. A remix method comprising:

a first storing step of storing musical tone pattern data of a predetermined length in a first storage device;

a dividing step of dividing the stored musical tone pattern data of the predetermined length into a plurality of musical tone piece data of a length smaller than the predetermined length;

a second storing step of storing in a second storage device location information indicative of locations in said first storage device where the musical tone piece data obtained by the division are stored;

a third storing step of storing in a third storage device a plurality of types of rearrangement information indicative of readout order in which said plurality of musical tone piece data obtained by the division;

a supplying step of supplying the location information corresponding to said musical tone piece data such that said musical tone piece data are rearranged in a readout order indicated by one rearrangement information selected from said plurality of types of stored rearrangement information;

a reproducing step of sequentially reproducing the musical tone piece data in an order indicated by the supplied location information in a manner such that when reproduction of the musical tone piece data proceeds to a trailing position of the musical tone pattern data, it is returned to a leading position of the musical tone pattern data to continue reproduction;

an outputting step of outputting operation data according to operation of the user;

an accepting step of accepting the outputted operation data at an intermediate position between the leading position and the trailing position of the musical tone pattern data when the reproduction of the musical tone pattern data is being carried out during said reproducing step at said intermediate position between the leading position and the trailing position of the musical tone pattern data; and a selecting step of selecting one rearrangement information from said plurality of types of stored rearrangement information according to the accepted operation data, in timing when the reproduction of musical tone piece data by said reproducing device proceeds to the trailing position of the musical tone pattern date and is returned to the leading position of the musical tone pattern data, the selected one rearrangement information being used to control the readout order of the location information supplying step.

20. A slice method comprising:

a first storing step of storing musical tone pattern data of a predetermined length in a first storage device;

a second storing step of storing in a second storage device a plurality of types of division information for dividing the stored musical tone pattern data of the predetermined length into a plurality of musical tone piece data of a length smaller than the predetermined length;

a dividing step of dividing the stored musical tone pattern data of the predetermined length into the plurality of musical tone piece data based on the first division information selected by a first operating element that selects one of the stored plurality of types of division information; and a reproducing step of reproducing each of the musical tone piece data by a length corresponding to a rate information indicative of a rate of each of the musical tone piece data obtained by the division, said rate information inputted by a second operating element, wherein while said reproducing step is reproducing the musical tone piece data, if said first operating element selects a second division information from the stored plurality of types of division information, said step of dividing divides the stored musical tone pattern data of the predetermined length into a plurality of musical tone piece data based on the second division information selected by said first operating element, whereby said reproducing step reproduces each of the musical tone piece data divided based on the second division information, and wherein while said reproducing step is reproducing the musical tone piece data, if said second operating element inputs a second rate information indicative of a rate of each of the musical tone piece data obtained by the division, to be reproduced, said reproducing step reproduces each of the musical tone piece data by a length corresponding to the second rate information inputted by said second operating element.

21. A machine-readable storage medium containing a group of instructions for causing a machine to execute a remix method comprising the steps of:

a first storing step of storing musical tone pattern data of a predetermined length in a first storage device;

a dividing step of dividing the stored musical tone pattern data of the predetermined length into a plurality of musical tone piece data of a length smaller than the predetermined length;

a second storing step of storing in a second storage device location information indicative of locations in said first storage device where the musical tone piece data obtained by the division are stored;

a third storing step of storing in a third storage device a plurality of types of rearrangement information indicative of readout order in which said plurality of musical tone piece data obtained by the division are to be read out;

a supplying step of supplying the location information corresponding to said musical tone piece data in first readout order indicated by a first rearrangement information so as to allow a user to select the first rearrangement information from amongst the stored plurality of types of rearrangement information; and a reproducing step of sequentially reproducing the musical tone piece data corresponding to the supplied location information in the first readout order, wherein while said reproducing step is reproducing said musical tone piece data in the first readout order, if said user selects a second rearrangement information from the stored plurality of types of rearrangement information, said supplying step stops supplying the location information corresponding to said musical tone piece data in the first readout order, and starts to supply the location information corresponding to said musical tone piece data in a second readout order indicated by the second rearrangement information, whereby said reproducing step changes the readout order from the first readout order to the second readout order and continues reproducing the musical tone piece data corresponding to the supplied location information.

22. A machine-readable storage medium containing a group of instructions for causing a machine to execute a remix/slicing method comprising the steps of:

a storing step of storing predetermined musical tone pattern data of a predetermined length in a storage device;

a reproducing step of reproducing the stored musical tone pattern data in a manner such that when reproduction of the stored musical tone pattern data proceeds to a trailing position of the musical tone pattern data, it is returned to a leading position of the musical tone pattern data to continue reproduction;

an accepting step of accepts operating element information generated by a user by operating an operating element device at an intermediate position between the leading position and the trailing position of the musical tone pattern data when the reproduction of the musical tone pattern data stored in the storage device is being carried out at said intermediate position between the leading position and the trailing position of the musical tone pattern data;

a control information generating step of generating control information for controlling a manner of said reproduction based on the accepted operating element information, in timing when the reproduction returns to the leading position of the musical tone pattern data upon proceeding to the trailing position thereof; and a control step of controlling the manner of said reproduction based on the generated control information.

23. A machine-readable storage medium containing a group of instructions for causing a machine to execute a remix method comprising the steps of:

a first storing step of storing musical tone pattern data of a predetermined length in a first storage device;

a dividing step of dividing the stored musical tone pattern data of the predetermined length into a plurality of musical tone piece data of a length smaller than the predetermined length;

a second storing step of storing in a second storage device location information indicative of locations in said first storage device where the musical tone piece data obtained by the division are stored;

a third storing step of storing in a third storage device a plurality of types of rearrangement information indicative of readout order in which said plurality of musical tone piece data obtained by the division;

a supplying step of supplying the location information corresponding to said musical tone piece data such that said musical tone piece data are rearranged in a readout order indicated by one rearrangement information selected from said plurality of types of stored rearrangement information;

a reproducing step of sequentially reproducing the musical tone piece data in an order indicated by the supplied location information in a manner such that when reproduction of the musical tone piece data proceeds to a trailing position of the musical tone pattern data, it is returned to a leading position of the musical tone pattern data to continue reproduction;

an outputting step of outputting operation data according to operation of the user;

an accepting step of accepting the outputted operation data at an intermediate position between the leading position and the trailing position of the musical tone pattern data when the reproduction of the musical tone pattern data ions being carried out during said reproducing step at said intermediate position between the leading position and the trailing position of the musical tone pattern data; and a selecting step of selecting one rearrangement information from said plurality of types of stored rearrangement information according to the accepted operation data, in timing when the reproduction of the musical tone piece data by said reproducing device proceeds to the trailing position of the musical tone pattern data and is returned to the leading position of the musical tone pattern data, the selected one rearrangement information being used to control the readout order of the location information supplied by said supplying step.

24. A machine-readable storage medium containing a group of instructions for causing a machine to execute a slice method comprising the steps of:

a first storing step of storing musical tone pattern data of a predetermined length in a first storage device;

a second storing step of storing in a second storage device a plurality of types of division information for dividing the stored musical tone pattern data of the predetermined length into a plurality of musical tone piece data of a length smaller than the predetermined length;

a dividing step of dividing the stored musical tone pattern data of the predetermined length into the plurality of musical tone piece data based on the first division information selected by a first operating element that selects one of the stored plurality of types of division information; and a reproducing step of reproducing each of the musical tone piece data by a length corresponding to a rate information indicative of a rate of each of the musical tone piece data obtained by the division, said rate information inputted by a second operating element, wherein while said reproducing step is reproducing the musical tone piece data, if said first operating element selects a second division information from the stored plurality of types of division information, said step of dividing divides the stored musical tone pattern data of the predetermined length into a plurality of musical tone piece data based on the second division information selected by said first operating element, whereby said reproducing step reproduces each of the musical tone piece data divided based on the second division information, and wherein while said reproducing step is reproducing the musical tone piece data, if said second operating element inputs a second rate information indicative of a rate of each of the musical tone piece data obtained by the division, to be reproduced, said reproducing step reproduces each of the musical tone piece data by a length corresponding to the second rate information inputted by said second operating element.

25. A slice apparatus comprising:

a first storage device that stores musical tone pattern data of a predetermined length;

a second storage device that stores a plurality of types of division information for dividing the stored musical tone pattern data of the predetermined length into a plurality of musical tone piece data of a length shorter than the predetermined length;

a dividing device that divides the stored musical tone pattern data of the predetermined length into the plurality of musical tone piece data, said division based on one division information selected from the stored plurality of types of division information;

a reproducing device that sequentially reproduces each of the musical tone piece data by a length corresponding to rate information that has been set and is indicative of a rate of each of the musical tone piece data obtained by the division, to be reproduced, in a manner such that when reproduction of the musical tone piece data proceeds to a trailing position of the musical tone pattern data, it is returned to a leading position of the musical tone pattern data to continue reproduction;

a first operating element device that outputs first operation data according to operation of a user;

a first accepting device that accepts the first operation data outputted from said first operating element device at an intermediate position between the leading position and the trailing position of the musical tone pattern data when the reproduction of the musical tone piece data is being carried out by said reproduction device at said intermediate position between the leading position and the trailing position of the musical tone pattern data;

a selecting device that selects one division information form said plurality of types of stored division information according to the accepted first operation data, in timing when the reproduction of the musical tone piece data by said reproducing device proceeds to the trailing position of the musical tone pattern data and is returned to the leading position of the musical tone pattern data, the selected one division information being used to control a manner of division of the musical tone pattern data into the plurality of musical tone piece data;

a second operating element device that outputs second operation data according to operation of the user;

a second accepting device that accepts the second operation data outputted from said second operating element device at an intermediate position between the leading position and the trailing position of the musical tone pattern data when the reproduction of the musical tone piece data is being carried out by said reproducing device at said intermediate position between the leading position and the trailing position of the musical tone pattern data; and a setting device that sets rate information, according to the accepted second operation data, in timing when the reproduction of the musical tone piece data by said reproducing device proceeds to the trailing position of the musical tone pattern data and is returned to the leading position of the musical tone pattern data, the set rate information being used to control a rate of each of the musical tone piece data to be reproduced by said reproducing device.

* * * * *